US007766677B2

(12) United States Patent
Chiang

(10) Patent No.: US 7,766,677 B2
(45) Date of Patent: Aug. 3, 2010

(54) DUSTPROOF RECEPTACLE CONNECTOR

(75) Inventor: Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 135 days.

(21) Appl. No.: 12/232,330

(22) Filed: Sep. 16, 2008

(65) Prior Publication Data

US 2010/0068909 A1 Mar. 18, 2010

(51) Int. Cl.
*H01R 13/44* (2006.01)

(52) U.S. Cl. ..... 439/140; 439/141; 439/607.54

(58) Field of Classification Search ..... 439/140, 439/141, 137, 135, 607.35, 607.54, 607.01
See application file for complete search history.

(56) References Cited

U.S. PATENT DOCUMENTS 3,754,205 A * 8/1973 Lenkey ..... 439/141
5,252,082 A * 10/1993 Hsieh et al. ..... 439/141
6,733,311 B2 * 5/2004 Kameda ..... 439/140
7,140,891 B1 * 11/2006 Huang et al. ..... 439/137
7,223,108 B2 * 5/2007 Chiang et al. ..... 439/137
7,438,600 B1 * 10/2008 Hung et al. ..... 439/630
7,527,504 B2 * 5/2009 Fujimoto et al. ..... 439/79
7,632,156 B1 * 12/2009 Chiang ..... 439/682
7,654,835 B1 * 2/2010 Chiang ..... 439/137
7,661,990 B1 * 2/2010 Chiang ..... 439/607.35

* cited by examiner

*Primary Examiner*—Xuong M Chung-Trans
(74) *Attorney, Agent, or Firm*—Rosenberg, Klein & Lee

(57) ABSTRACT

A dustproof receptacle connector includes a dielectric housing, a plurality of terminals, a shield and a dustproof cover. The dielectric housing defines a plurality of terminal grooves therein for receiving the terminals. The shield surrounding the dielectric housing has a top board. A sliding groove is defined in the top board and extends longitudinally to pass through a rear end of the top board. An engaging portion extends from the rear end of the top board. A receiving groove is surrounded by the engaging portion and the rear end of the top board and communicates with the sliding groove. The engaging portion is bent downward to be attached to a rear portion of the dielectric housing. The dustproof cover is slidably received in the shield and located between the dielectric housing and a front end of the shield. The dustproof cover has a positioning portion slidable along the sliding groove.

6 Claims, 5 Drawing Sheets

DUSTPROOF RECEPTACLE CONNECTOR

BACKGROUND OF THE INVENTION

1. Field of the Invention

The present invention generally relates to a receptacle connector, and more particularly to a dustproof receptacle connector.

2. The Related Art

Electronic products are more and more widely used with the development of the technology of the electrons. Connectors are also widely used with the development of the technology of the electrons. However, terminals of the connectors are easy to be dirtied and degraded by the dust. So, a dustproof receptacle connector is needed urgently.

A conventional dustproof receptacle connector is shown in FIG. 1. The dustproof receptacle connector 1' includes a shield 11', a dielectric housing 21' received in the shield 11' and a dustproof cover received in the shield 11'. The shield 11' has a top board 111' which defines two grooves 112' parallel to each other in the middle. The two grooves 112' extend to a rear end of the top board 111' and penetrate the rear end. The dustproof cover has two positioning pillars 241 ' thereon which are respectively disposed in the two grooves 112'.

When a complementary plug connector is inserted into the dustproof receptacle connector 1', the dustproof cover is pushed inward by the plug connector and the positioning pillars 241' slide along the grooves 112'. As the two grooves 112' penetrate the rear end of the top board 111', the part of the top board 111' between the two grooves 112' is only held by one side thereof. So the part of the top board 111' between the two grooves 112' is easy to be raised upward and deformed when the positioning pillars 241' slide in the grooves 112', which will affect the slide of the dustproof cover.

SUMMARY OF THE INVENTION

An object of the present invention is to provide a dustproof receptacle connector. The dustproof receptacle connector includes a dielectric housing, a plurality of terminals, a shield and a dustproof cover. The dielectric housing defines a plurality of terminal grooves therein for receiving the terminals. The shield surrounding the dielectric housing has a top board. A sliding groove is defined in the top board and extends longitudinally to pass through a rear end of the top board. An engaging portion extends from the rear end of the top board. A receiving groove is surrounded by the engaging portion and the rear end of the top board and communicates with the sliding groove. The engaging portion is bent downward to be attached to a rear portion of the dielectric housing. The dustproof cover is slidably received in the shield and located between the dielectric housing and a front end of the shield. The dustproof cover has a positioning portion slidable along the sliding groove.

As described above, because the engaging portion is bent downward to be attached to the rear portion of the dielectric housing to provide a force for the top board on two sides of the sliding groove, the top board on two sides of the sliding groove can avoid being destroyed when the positioning portion of the dustproof cover slides in the sliding groove, which makes the slide of the dustproof cover more smoothly.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
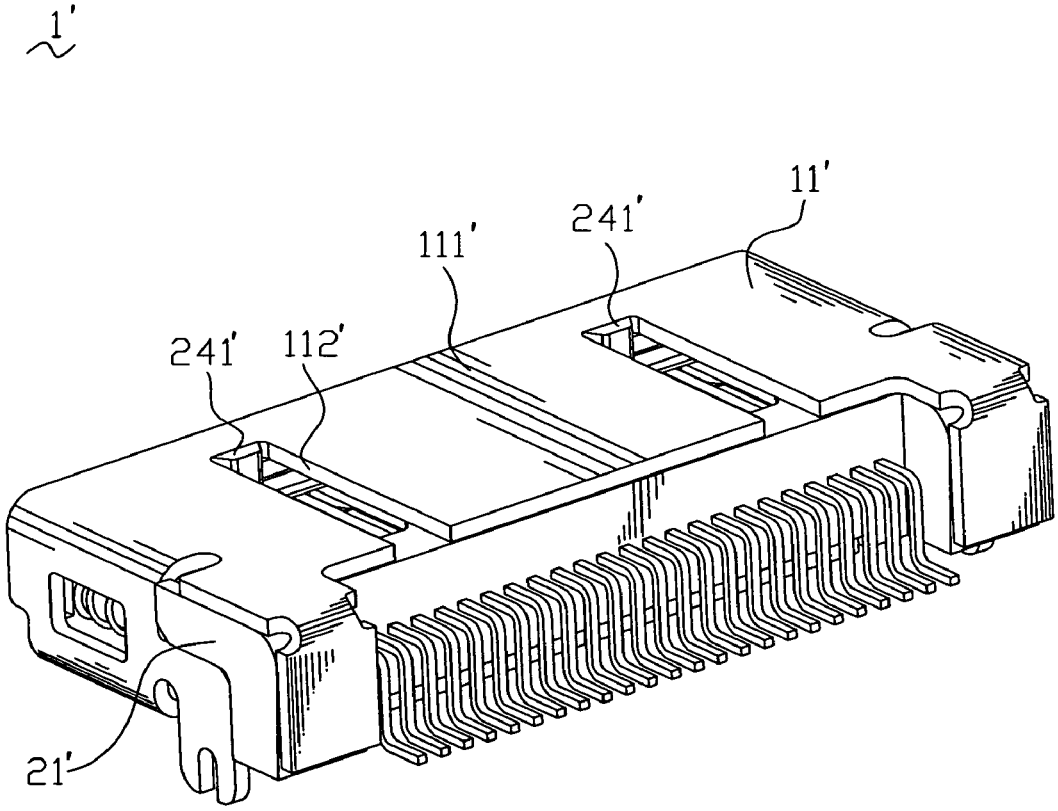
FIG. 1 (Prior Art)
FIG. 1 is a perspective view of a conventional dustproof receptacle connector.
Figure 2:
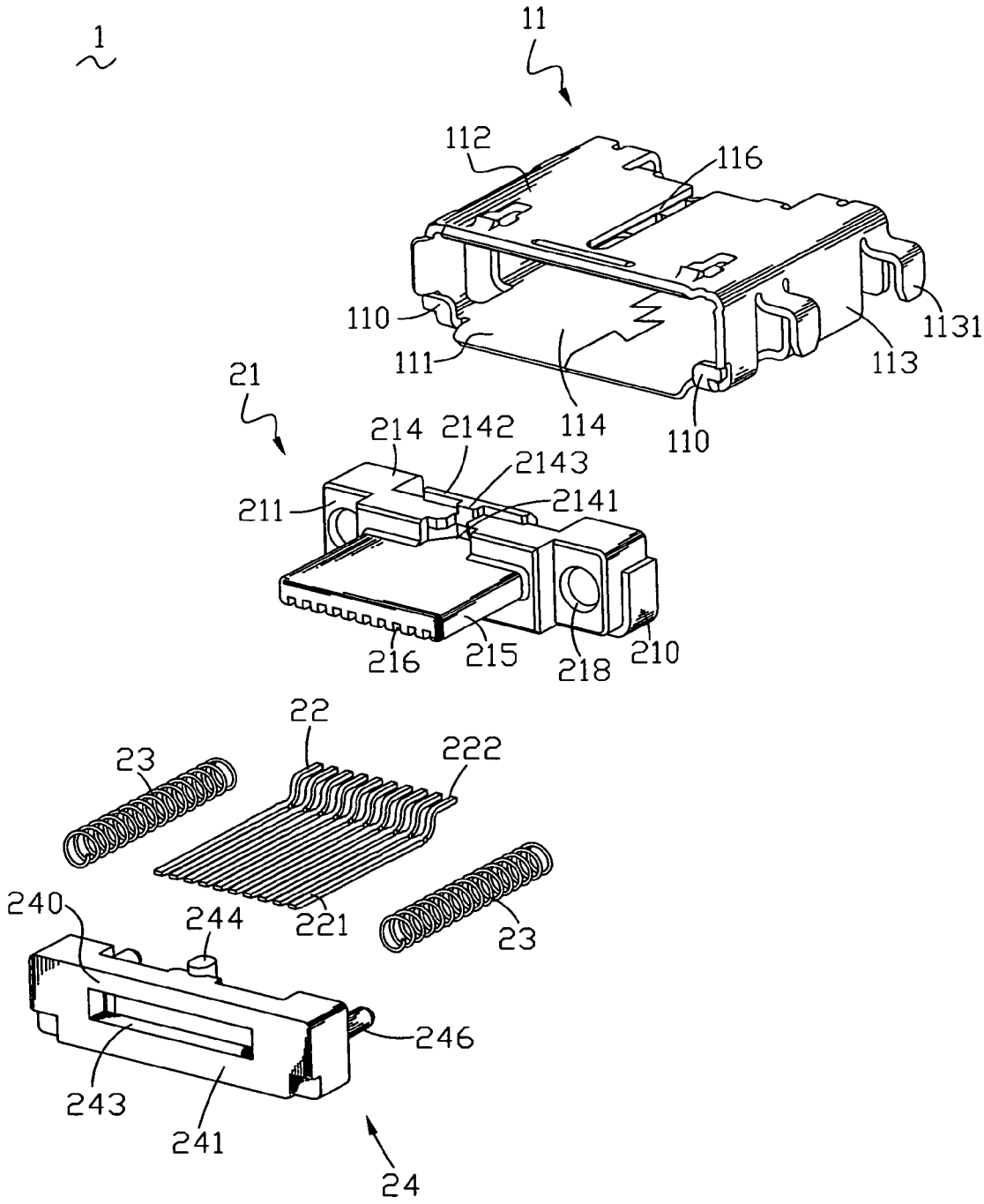
FIG. 2 is an exploded view of a dustproof receptacle connector according to the present invention.

With reference to FIG. 2, a dustproof receptacle connector 1 according to the present invention includes a shield 11, a dielectric housing 21 received in the shield 11, a plurality of terminals 22 which are received in the dielectric housing 21, a dustproof cover 24 and an elastic element 23 both received in the shield 11. In this embodiment, the elastic element 23 is two coils of springs.

Figure 7:
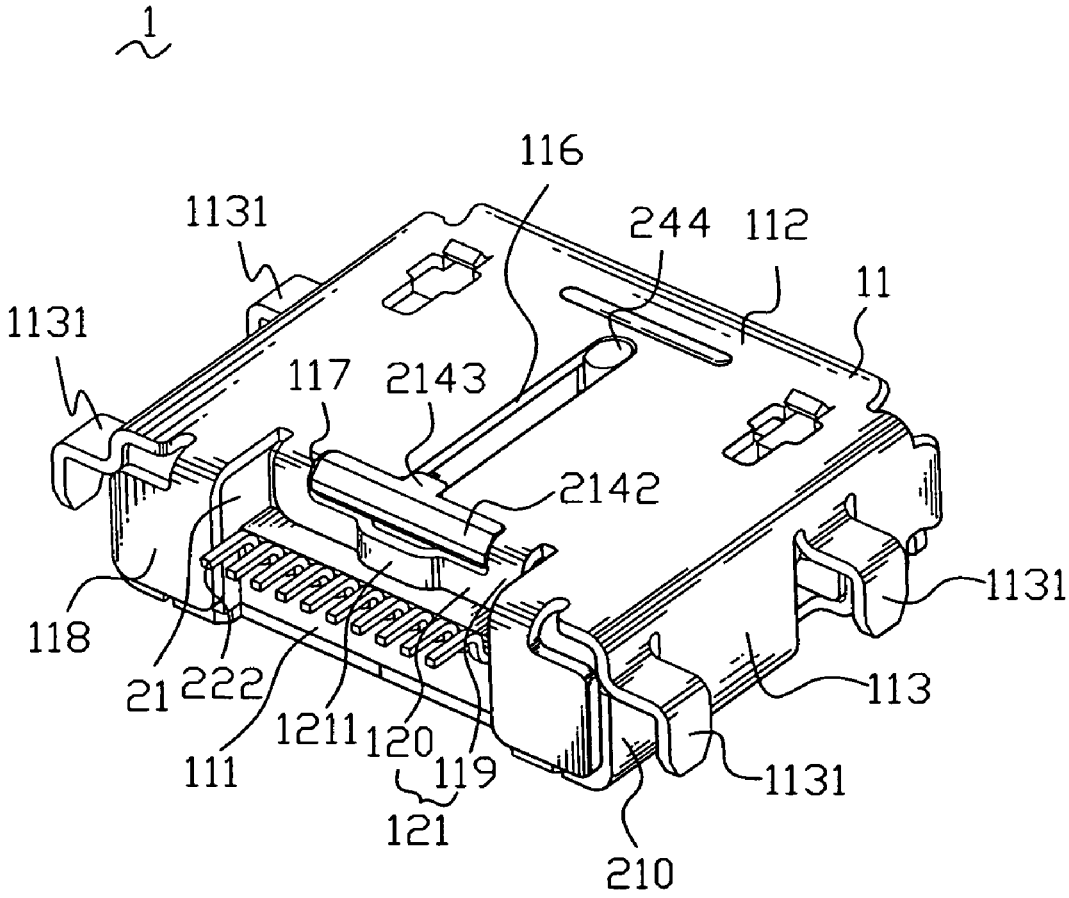
FIG. 7 is a perspective view of the dustproof receptacle connector shown in FIG. 2.

Please refer to FIGS. 2 and 7, the shield 11 includes a bottom board 111, a top board 112 opposite to the bottom board 111, and two sideboards 113 connected to two sides of the bottom board 111 and the top board 112. A receiving cavity 114 is surrounded by the bottom board 111, the top board 112 and the two sideboards 113.

Figure 3:
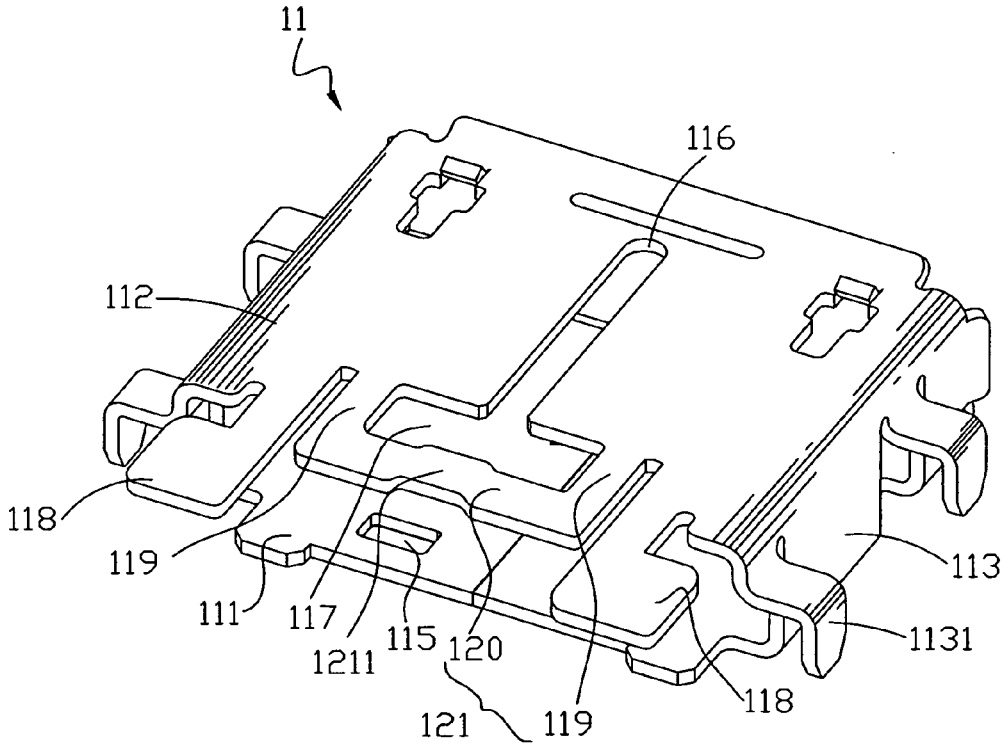
FIG. 3 is a perspective view of a shield of the dustproof receptacle connector shown in FIG. 2 prior to assembly.

Please refer to FIGS. 2 and 3, the junctions of the bottom board 111 and the two sideboards 113 are bent upward to form two hooks 110. Two apertures 115 are formed in a rear end of the bottom board 111. An elongated sliding groove 116 is formed in a middle portion of the top board 112 and extends longitudinally to a rear end of the top board 112. Two engaging pieces 119 extend rearward abreast from the rear end of the top board 112 and are located at two sides of the sliding groove 116. A connecting portion 120 is connected to a free end of each engaging piece 119 and perpendicular to the two engaging pieces 119. The middle of the connecting portion 120 is punched upward to form an archway 1211. The two engaging pieces 119 and the connecting portion 120 constitute an engaging portion 121. A substantially rectangular receiving groove 117 is surrounded by the engaging portion 121 and the rear end of the top board 112. The receiving groove 117 is perpendicular to the sliding groove 116 and communicates with the sliding groove 116. Two ends of the rear end of the top board 112 extend rearward abreast to form two retaining pieces 118. Two ends of each sideboard 113 are respectively cut and bend outward to form a fixing piece 1131 of L-shape. The fixing pieces 1131 are inserted into a printed circuit board (not shown) to fix the dustproof receptacle connector 1 on the printed circuit board.

Figure 4:
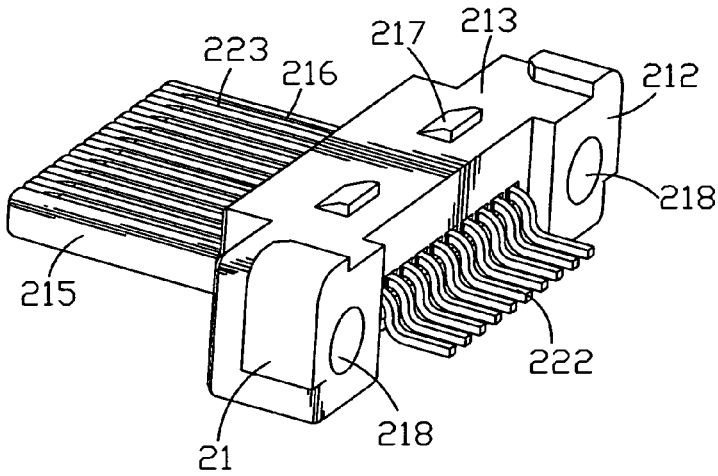
FIG. 4 is a perspective view of a dielectric housing assembled with a plurality of terminals therein of the dustproof receptacle connector shown in FIG. 2.

With reference to FIGS. 2 and 4, the dielectric housing 21 received in the receiving cavity 114 of the shield 11 has a substantially rectangular basic portion 210. The basic portion 210 has a front side 211, a rear side 212 opposite to the front side 211, a bottom side 213 and a top side 214 opposite to the bottom side 213. The middle of the front side 211 of the basic portion 210 extends forward to form an extending board 215. A plurality of terminal grooves 216 is abreast formed in a bottom surface of the extending board 215 and the basic portion 210 and extends from a front end of the extending board 215 to the rear side 212. A pair of lumps 217 is protruded from the bottom side 213 of the basic portion 210 for mating with the apertures 115 of the shield 11 to position the dielectric housing 21 inside the shield 11. Two holes 218 are respectively formed in two ends of the basic portion 210 and extend from the front side 211 to the rear side 212. The middle of the top side 214 is dented to form a gap 2141. A bump 2142 is protruded from the basic portion 210 to across the junction of the top side 214 and the rear side 212. The bump 2142 is behind the gap 2141. The middle of the bump 2142 is protruded forward to form a projection 2143.

Each of the terminals 22 includes a contact portion 221 and a soldering portion 222 bending and extending from a rear end of the contact portion 221. The contact portion 221 is received in the terminal groove 216 and the soldering portion 222 extends out of the rear side 212 of the dielectric housing 21.

Figure 5:
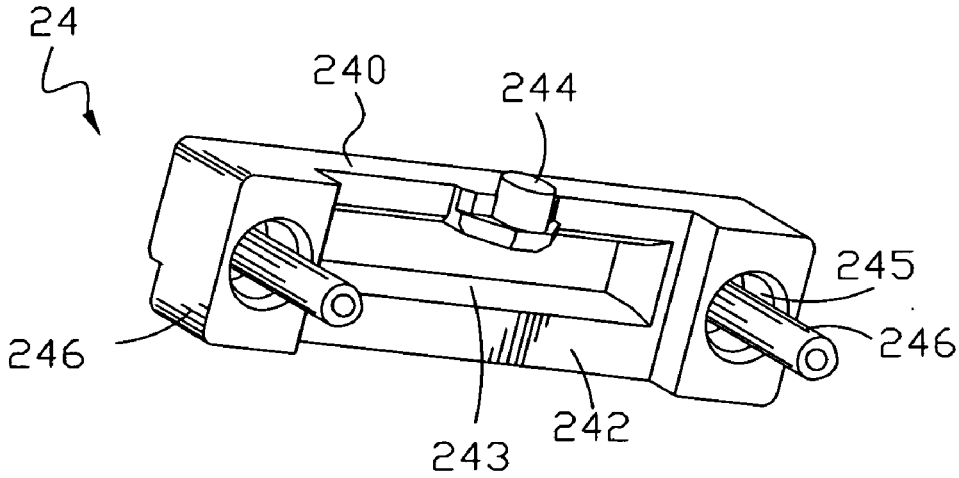
FIG. 5 is a perspective view of a dustproof cover of the dustproof receptacle connector shown in FIG. 2.

Please refer to FIGS. 2 and 5, the dustproof cover 24 of a substantially rectangular shape has a base 240. The base 240 defines a front surface 241 and a rear surface 242 opposite to the front surface 241. A rectangular slot 243 is formed in the middle of the base 240 and extends from the front surface 241 to the rear surface 242. A cylindrical positioning portion 244 is protruded upward from the middle of a rear end of the base 240. Two openings 245 are respectively formed in two ends of the rear surface 242 of the base 240. A bottom of each opening 245 extends rearward to form a rod 246 which extends out of the base 240.

Figure 6:
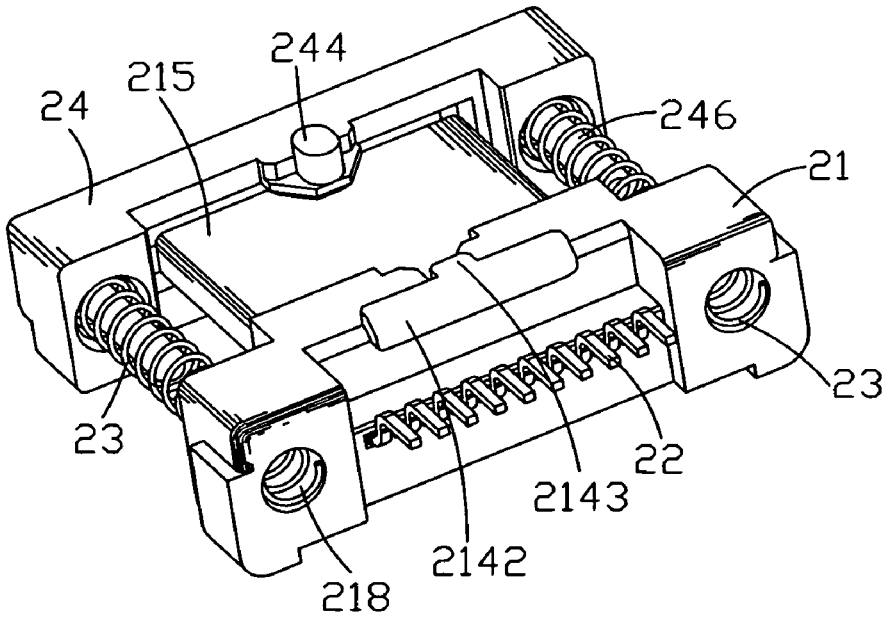
FIG. 6 is a perspective view of the dustproof receptacle connector shown in FIG. 2 without the shield.

Please refer to FIGS. 6 and 7, in assembly, firstly, the dustproof cover 24 is inserted into the receiving cavity 114 of the shield 11 through the rear end of the shield 11 until the dustproof cover 24 is restricted by the hooks 110 of the shield 11. More specially, the positioning portion 244 is firstly moved into the receiving groove 117 under the archway 1211 and then slides into the sliding groove 116. The positioning portion 244 slides forward along the sliding groove 116 until the positioning portion 244 is restricted by the head of the sliding groove 116. Secondly, the dielectric housing 21 with the terminals 22 therein is inserted into the receiving cavity 114 of the shield 11. The front end of the extending board 215 of the dielectric housing 21 is inserted into the slot 243 of the dustproof cover 24. The bump 2142 is wedged into the receiving groove 117 from the bottom of the connecting portion 120. The projection 2143 is jammed in the end of the sliding groove 116 communicating with the receiving groove 117. The lumps 217 are respectively inserted into the apertures 115. Thirdly, one end of each of the springs 23 passes through the hole 218 of the dielectric housing 21 to be received in the opening 245 and surround the rod 246. The opposite end of each of the springs 23 is received in the hole 218. At last, the retaining pieces 118 and the engaging portion 121 are respectively bent downward. The end of each of the springs 23 received in the hole 218 is restricted by the retaining piece 118. The engaging portion 121 is attached to the rear end of the dielectric housing 21. The bump 2142 is engaged in the receiving groove 117.

As described above, because the engaging portion 121 is bent downward and attached to the rear end of the dielectric housing 21 to provide a force for the top board 112 on two sides of the sliding groove 116, the top board 112 on two sides of the sliding groove 116 can avoid being destroyed when the positioning portion 244 of the dustproof cover 24 slides in the sliding groove 116, which makes the slide of the dustproof cover 24 more smoothly.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A dustproof receptacle connector, comprising:

a dielectric housing defining a plurality of terminal grooves therein;

a plurality of terminals received in the terminal grooves of the dielectric housing;

a shield surrounding the dielectric housing and having a top board, a sliding groove being defined in the top board and extending longitudinally to pass through a rear end of the top board, an engaging portion extending from the rear end of the top board, a receiving groove being surrounded by the engaging portion and the rear end of the top board and communicating with the sliding groove, the engaging portion being bent downward to be attached to a rear portion of the dielectric housing; and a dustproof cover slidably received in the shield and located between the dielectric housing and a front end of the shield, the dustproof cover having a positioning portion slidable along the sliding groove, wherein the dielectric housing has a basic portion, a bump is protruded from the basic portion to across the junction of an upper surface and a rear surface of the basic portion and is wedged to the receiving groove of the shield from a bottom of a rear of the engaging portion when the engaging portion is bent.

2. The dustproof receptacle connector as claimed in claim 1, wherein a rear of the engaging portion is punched upward to form an archway corresponding to the sliding groove for allowing the positioning portion to pass therefrom.

3. The dustproof receptacle connector as claimed in claim 1, wherein a projection is protruded forward from a middle of the bump and jammed into the sliding groove.

4. The dustproof receptacle connector as claimed in claim 1, wherein the engaging portion includes two engaging pieces respectively extending from the rear end of the top board and located at two sides of the sliding groove, and a connecting portion connecting two free ends of the engaging pieces to make the receiving groove substantially rectangular.

5. The dustproof receptacle connector as claimed in claim 4, wherein a middle of the connecting portion is punched upward to form an archway corresponding to the sliding groove for allowing the positioning portion passing therefrom.

6. The dustproof receptacle connector as claimed in claim 1, further comprising an elastic element, one end of which is against the dustproof cover, and the other end of which passes through the dielectric housing and is against the shield.

* * * * *